US009320367B2

(12) United States Patent
Chambers

(10) Patent No.: US 9,320,367 B2
(45) Date of Patent: Apr. 26, 2016

(54) SNAP-IN PUSHER

(71) Applicant: Kyle Chambers, Rockford, IL (US)

(72) Inventor: Kyle Chambers, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 60 days.

(21) Appl. No.: 14/190,500

(22) Filed: Feb. 26, 2014

(65) Prior Publication Data

US 2015/0238026 A1 Aug. 27, 2015

(51) Int. Cl.

| | |
|---|---|
| ***A47F 1/04*** | (2006.01) |
| ***A47F 1/12*** | (2006.01) |
| ***A47F 5/00*** | (2006.01) |

(52) U.S. Cl.

CPC ..... *A47F 1/126* (2013.01); *A47F 5/005* (2013.01)

(58) Field of Classification Search

CPC .... A47B 73/00; A47B 73/002; A47B 73/006; A47B 73/008; A47B 57/42; A47B 96/061; A47F 1/126; A47F 1/12; A47F 1/125; A47F 1/128; A47F 1/121; A47F 5/13; A47F 5/01; A47F 5/0846; A47F 5/0869; A47F 5/0838; A47F 7/285; A47F 5/005

USPC ..... 211/74, 75, 51, 59.3, 59.1, 59.2, 184

See application file for complete search history.

(56) References Cited

U.S. PATENT DOCUMENTS

| | | | |
|---|---|---|---|
| 101,058 | A | 3/1870 | Süwerkroh |
| 1,832,884 | A | 11/1931 | Ulrich |
| 1,910,046 | A | 5/1933 | Pascoe |
| 2,738,881 | A | 3/1956 | Michel |
| 2,855,258 | A | 10/1958 | Moncier |
| 3,235,092 | A | 2/1966 | Schwarz |
| 3,787,018 | A | 1/1974 | Nathan |
| 3,788,489 | A | 1/1974 | Levinthal |
| 3,848,745 | A | 11/1974 | Smith |
| 3,850,534 | A | 11/1974 | O'Halloran |
| D247,144 | S | 2/1978 | Nathan |
| 4,183,438 | A | 1/1980 | Huczek |
| 4,238,022 | A | 12/1980 | Williams |

(Continued)

FOREIGN PATENT DOCUMENTS

| | | | |
|---|---|---|---|
| DE | 202005010088 | U1 | 9/2005 |
| EP | 0 267 569 | A2 | 5/1988 |

(Continued)

OTHER PUBLICATIONS

U.S. Appl. No. 13/713,886, filed Dec. 13, 2012, Valiulis.

(Continued)

*Primary Examiner* — Korie H Chan

(74) *Attorney, Agent, or Firm* — Reinhart Boerner Van Deuren P.C.

(57) ABSTRACT

A retail merchandise pusher system that includes a front fence configured to attach to a shelf, and a plurality of single-piece track and divider assemblies. Each single-piece track and divider assembly has a divider attached to a track, and is configured to attach to the front fence by means of a connector. The retail merchandise pusher system also includes a pusher assembly for each of the plurality of single-piece track and divider assemblies. Each pusher assembly is configured to slide along its respective track. The pusher assembly has a pusher paddle, and a spring to bias the pusher paddle towards the front fence.

15 Claims, 6 Drawing Sheets

(56) References Cited

U.S. PATENT DOCUMENTS 4,289,242 A 9/1981 Kenyon
4,303,162 A 12/1981 Suttles
4,435,031 A 3/1984 Black et al.
4,474,297 A 10/1984 Zucker
4,475,658 A 10/1984 Roberts
4,505,395 A 3/1985 Nathan
4,550,838 A 11/1985 Nathan et al.
D284,049 S 6/1986 Nathan et al.
4,606,465 A 8/1986 Moustakas
D286,837 S 11/1986 Nathan
D288,784 S 3/1987 Nathan et al.
D290,566 S 6/1987 Nathan et al.
D290,670 S 7/1987 Nathan et al.
D290,790 S 7/1987 Nathan et al.
4,712,694 A 12/1987 Breslow
4,742,923 A 5/1988 Calvert
4,742,936 A 5/1988 Rein
4,821,894 A 4/1989 Dechirot
4,830,201 A 5/1989 Breslow
4,836,390 A 6/1989 Polvere
4,881,916 A 11/1989 Houser
4,887,737 A 12/1989 Adenau
4,899,668 A 2/1990 Valiulis
4,901,869 A 2/1990 Hawkinson et al.
4,934,645 A 6/1990 Breslow
4,976,360 A 12/1990 Zucker et al.
5,009,334 A 4/1991 Bodkins
5,012,936 A 5/1991 Crum
D321,101 S 10/1991 Zucker
D321,296 S 11/1991 Miranda
5,069,349 A 12/1991 Wear et al.
5,083,638 A 1/1992 Schneider
5,114,021 A 5/1992 Fredrickson
D327,190 S 6/1992 Wear et al.
D330,121 S 10/1992 Wear et al.
5,161,704 A 11/1992 Valiulis
5,188,413 A 2/1993 Nathan
5,190,186 A 3/1993 Yablans et al.
5,191,983 A 3/1993 Hardy
5,222,608 A 6/1993 Eklof et al.
5,240,126 A 8/1993 Foster et al.
5,265,738 A 11/1993 Yablans et al.
5,353,714 A 10/1994 Hardy
5,362,051 A 11/1994 Swafford, Jr. et al.
5,390,802 A 2/1995 Pappagallo et al.
5,437,116 A 8/1995 Hardy
5,450,969 A 9/1995 Johnson et al.
5,464,105 A 11/1995 Mandeltort
5,485,929 A 1/1996 Danon
5,562,217 A 10/1996 Salveson et al.
5,581,281 A 12/1996 Fuse
5,608,449 A 3/1997 Swafford, Jr. et al.
5,634,564 A 6/1997 Spamer et al.
5,641,077 A 6/1997 Tufano et al.
5,647,566 A 7/1997 Kump
5,664,749 A 9/1997 Kump et al.
5,665,304 A 9/1997 Heinen et al.
5,669,527 A 9/1997 Hardy
5,671,362 A 9/1997 Cowe et al.
5,671,851 A 9/1997 Johnson et al.
5,673,801 A 10/1997 Markson
5,682,824 A 11/1997 Visk
5,685,664 A 11/1997 Parham et al.
5,690,238 A 11/1997 Schmehr
5,706,957 A 1/1998 Hardy
D390,052 S 2/1998 Wolff
5,730,320 A 3/1998 David
5,743,428 A 4/1998 Rankin, VI
5,839,588 A 11/1998 Hawkinson
D402,823 S 12/1998 Anderson et al.
5,855,281 A 1/1999 Rabas
5,855,282 A 1/1999 Hardy
5,855,283 A 1/1999 Johnson
5,906,283 A 5/1999 Kump et al.
5,924,367 A 7/1999 Henke et al.
5,970,887 A 10/1999 Hardy
5,971,173 A 10/1999 Valiulis et al.
6,041,720 A 3/2000 Hardy
6,082,558 A 7/2000 Battaglia
6,082,687 A 7/2000 Kump et al.
6,102,192 A 8/2000 Tomuro et al.
6,105,791 A 8/2000 Chalson et al.
6,109,458 A 8/2000 Walsh et al.
6,129,218 A 10/2000 Henry et al.
6,131,748 A 10/2000 Kawasaki et al.
6,142,317 A 11/2000 Merl
6,158,598 A 12/2000 Josefsson
6,227,385 B1 * 5/2001 Nickerson ..... 211/59.3
6,234,436 B1 5/2001 Kump
D445,615 S 7/2001 Burke
6,253,954 B1 7/2001 Yasaka
6,269,285 B1 7/2001 Mignault
6,286,690 B1 9/2001 Thalenfeld
6,290,074 B1 9/2001 Syvuk et al.
6,299,004 B1 10/2001 Thalenfeld et al.
6,305,559 B1 10/2001 Hardy
6,341,755 B1 1/2002 Kump
6,354,546 B1 3/2002 Mueller
6,357,606 B1 3/2002 Henry
6,364,136 B1 4/2002 Weshler et al.
6,382,431 B1 5/2002 Burke
6,401,942 B1 6/2002 Eckert
6,405,880 B1 6/2002 Webb
6,409,028 B2 6/2002 Nickerson
6,427,858 B2 8/2002 Sabounjian
6,464,089 B1 10/2002 Rankin, VI
6,474,478 B1 11/2002 Huehner et al.
D472,331 S 3/2003 Zadak
6,533,131 B2 3/2003 Bada
D472,411 S 4/2003 Burke
6,607,083 B1 8/2003 Webb
6,622,874 B1 9/2003 Hawkinson
D480,231 S 10/2003 Valiulis et al.
6,655,536 B2 12/2003 Jo et al.
6,659,291 B2 12/2003 Huehner et al.
D485,699 S 1/2004 Mueller et al.
6,719,152 B1 4/2004 Nagel et al.
6,745,906 B1 6/2004 Nagel
6,769,552 B1 8/2004 Thalenfeld
6,772,888 B2 8/2004 Burke
6,783,012 B2 8/2004 Webb
6,820,754 B2 11/2004 Ondrasik
6,824,009 B2 11/2004 Hardy
6,866,155 B2 3/2005 Nagel
6,866,156 B2 3/2005 Nagel et al.
6,874,684 B1 4/2005 Denenberg et al.
6,886,699 B2 5/2005 Johnson et al.
6,886,700 B2 5/2005 Nagel
6,889,854 B2 5/2005 Burke
6,889,855 B2 5/2005 Nagel
D507,915 S 8/2005 Nagel
6,923,330 B1 8/2005 Nagel
6,932,226 B2 8/2005 Hardy
6,964,235 B2 11/2005 Hardy
7,007,810 B2 3/2006 Huehner et al.
7,028,852 B2 4/2006 Johnson et al.
7,032,761 B2 4/2006 Nagel
7,093,546 B2 8/2006 Hardy
7,150,365 B2 12/2006 Hardy et al.
7,152,536 B2 12/2006 Hardy
7,216,770 B2 5/2007 Mueller et al.
7,293,663 B2 11/2007 Lavery, Jr.
7,299,934 B2 11/2007 Hardy et al.
7,325,348 B2 2/2008 Mueller et al.
7,389,886 B2 6/2008 Hardy et al.
7,395,938 B2 7/2008 Merit et al.
7,404,494 B2 7/2008 Hardy
7,419,062 B2 9/2008 Mason
7,424,957 B1 9/2008 Luberto
7,451,881 B2 11/2008 Hardy et al.
7,458,473 B1 12/2008 Mason
7,497,341 B2 3/2009 Hardy et al.
7,497,342 B2 3/2009 Hardy
7,533,784 B2 5/2009 Vlastakis et al.

(56) References Cited

U.S. PATENT DOCUMENTS

| | | | | |
|---|---|---|---|---|
| 7,566,037 | B2 | 7/2009 | Vogler | |
| 7,681,744 | B2 | 3/2010 | Johnson | |
| 7,690,519 | B2 | 4/2010 | Kahl et al. | |
| 7,768,399 | B2 | 8/2010 | Hachmann et al. | |
| 7,784,623 | B2 * | 8/2010 | Mueller et al. | 211/59.3 |
| 7,792,711 | B2 | 9/2010 | Swafford, Jr. et al. | |
| 7,854,334 | B2 | 12/2010 | Nagel et al. | |
| 7,896,171 | B2 | 3/2011 | Battaglia | |
| 7,905,364 | B2 | 3/2011 | Pail | |
| 7,926,668 | B2 | 4/2011 | Barkdoll | |
| 7,931,156 | B2 | 4/2011 | Hardy | |
| 8,016,128 | B2 | 9/2011 | Valiulis et al. | |
| 8,069,994 | B2 | 12/2011 | Barkdoll | |
| 8,210,367 | B2 | 7/2012 | Nagel et al. | |
| 8,240,486 | B2 | 8/2012 | Niederhuefner et al. | |
| 8,328,027 | B2 | 12/2012 | Barkdoll | |
| 8,453,851 | B2 | 6/2013 | Ciesick | |
| 8,720,702 | B2 | 5/2014 | Nagel | |
| 2001/0002210 | A1 | 5/2001 | Petite | |
| 2001/0002659 | A1 * | 6/2001 | Bada | 211/59.2 |
| 2001/0044751 | A1 | 11/2001 | Pugliese, III et al. | |
| 2002/0004690 | A1 | 1/2002 | Paulucci et al. | |
| 2002/0108916 | A1 | 8/2002 | Nickerson | |
| 2002/0148794 | A1 | 10/2002 | Marihugh | |
| 2003/0004784 | A1 | 1/2003 | Li et al. | |
| 2003/0029816 | A1 | 2/2003 | Huehner et al. | |
| 2003/0057167 | A1 | 3/2003 | Johnson et al. | |
| 2003/0094462 | A1 | 5/2003 | Hardy | |
| 2003/0141265 | A1 | 7/2003 | Jo et al. | |
| 2003/0196972 | A1 | 10/2003 | Webb | |
| 2004/0034581 | A1 | 2/2004 | Hill et al. | |
| 2004/0065631 | A1 | 4/2004 | Nagel | |
| 2004/0073334 | A1 | 4/2004 | Terranova | |
| 2004/0084386 | A1 | 5/2004 | Huehner et al. | |
| 2004/0118794 | A1 | 6/2004 | Hardy | |
| 2004/0124201 | A1 | 7/2004 | Hieb | |
| 2004/0140278 | A1 | 7/2004 | Mueller et al. | |
| 2004/0140279 | A1 | 7/2004 | Mueller et al. | |
| 2004/0178103 | A1 | 9/2004 | Dey | |
| 2004/0182976 | A1 | 9/2004 | Valiulis et al. | |
| 2004/0200793 | A1 | 10/2004 | Hardy | |
| 2004/0245197 | A1 | 12/2004 | McElvaney | |
| 2005/0000924 | A1 | 1/2005 | Webb | |
| 2005/0040123 | A1 | 2/2005 | Ali | |
| 2005/0056602 | A1 | 3/2005 | Hardy | |
| 2005/0077260 | A1 | 4/2005 | Mueller et al. | |
| 2005/0092703 | A1 | 5/2005 | Mueller et al. | |
| 2005/0098626 | A1 | 5/2005 | Jordan et al. | |
| 2005/0127014 | A1 | 6/2005 | Richter et al. | |
| 2005/0161420 | A1 | 7/2005 | Hardy et al. | |
| 2005/0166438 | A1 | 8/2005 | Mueller et al. | |
| 2005/0166806 | A1 | 8/2005 | Hardy | |
| 2005/0168345 | A1 | 8/2005 | Swafford, Jr. et al. | |
| 2005/0189309 | A1 | 9/2005 | Hardy | |
| 2005/0189369 | A1 | 9/2005 | Vlastakis et al. | |
| 2005/0218094 | A1 | 10/2005 | Howerton et al. | |
| 2005/0269279 | A1 | 12/2005 | Hardy et al. | |
| 2005/0279722 | A1 | 12/2005 | Ali | |
| 2005/0286700 | A1 | 12/2005 | Hardy | |
| 2006/0021957 | A1 | 2/2006 | Hardy | |
| 2006/0049122 | A1 | 3/2006 | Mueller et al. | |
| 2006/0076301 | A1 | 4/2006 | Caterinacci et al. | |
| 2006/0096938 | A1 | 5/2006 | Kanou | |
| 2006/0163180 | A1 | 7/2006 | Rankin, VI et al. | |
| 2006/0186065 | A1 | 8/2006 | Ciesick | |
| 2006/0201897 | A1 | 9/2006 | Mueller et al. | |
| 2006/0219517 | A1 | 10/2006 | Cheng et al. | |
| 2006/0226095 | A1 | 10/2006 | Hardy | |
| 2006/0237381 | A1 | 10/2006 | Lockwood et al. | |
| 2006/0240398 | A1 | 10/2006 | Hardy et al. | |
| 2006/0273053 | A1 | 12/2006 | Roslof et al. | |
| 2007/0029270 | A1 | 2/2007 | Hawkinson | |
| 2007/0050271 | A1 | 3/2007 | Ufford et al. | |
| 2007/0075028 | A1 | 4/2007 | Nagel et al. | |
| 2007/0080166 | A1 | 4/2007 | Alford et al. | |
| 2007/0084812 | A1 | 4/2007 | Hardy et al. | |
| 2007/0090068 | A1 | 4/2007 | Hardy | |
| 2007/0095767 | A1 | 5/2007 | Henke et al. | |
| 2007/0095772 | A1 | 5/2007 | Hardy | |
| 2007/0095903 | A1 | 5/2007 | Suenbuel | |
| 2007/0102377 | A1 | 5/2007 | Kikuchi et al. | |
| 2007/0158281 | A1 | 7/2007 | Hardy | |
| 2007/0175839 | A1 | 8/2007 | Schneider et al. | |
| 2007/0175844 | A1 | 8/2007 | Schneider | |
| 2007/0175845 | A1 | 8/2007 | Hardy | |
| 2007/0187344 | A1 | 8/2007 | Mueller et al. | |
| 2007/0193971 | A1 | 8/2007 | Hardy et al. | |
| 2007/0236111 | A1 | 10/2007 | Gray | |
| 2007/0251900 | A1 | 11/2007 | Hardy | |
| 2007/0256992 | A1 | 11/2007 | Olson | |
| 2007/0267364 | A1 | 11/2007 | Barkdoll | |
| 2007/0267367 | A1 | 11/2007 | Mueller et al. | |
| 2007/0273513 | A1 | 11/2007 | White | |
| 2008/0015956 | A1 | 1/2008 | Regard | |
| 2008/0017598 | A1 | 1/2008 | Rataiczak, III et al. | |
| 2008/0061015 | A1 | 3/2008 | Hardy et al. | |
| 2008/0129161 | A1 | 6/2008 | Menz et al. | |
| 2008/0135507 | A1 | 6/2008 | Hardy et al. | |
| 2008/0203253 | A1 | 8/2008 | Vogler | |
| 2008/0217269 | A1 | 9/2008 | Topping et al. | |
| 2008/0283477 | A1 | 11/2008 | Wamsley et al. | |
| 2008/0290056 | A1 | 11/2008 | Hardy | |
| 2008/0309489 | A1 | 12/2008 | Hachmann et al. | |
| 2009/0006196 | A1 | 1/2009 | Barkan et al. | |
| 2009/0101606 | A1 | 4/2009 | Olson | |
| 2009/0184069 | A1 | 7/2009 | Hardy | |
| 2009/0248198 | A1 | 10/2009 | Siegel et al. | |
| 2010/0012602 | A1 * | 1/2010 | Valiulis et al. | 211/59.3 |
| 2010/0025346 | A1 | 2/2010 | Crawbuck et al. | |
| 2010/0078398 | A1 | 4/2010 | Hardy | |
| 2010/0108624 | A1 | 5/2010 | Sparkowski | |
| 2010/0176075 | A1 | 7/2010 | Nagel et al. | |
| 2010/0176077 | A1 | 7/2010 | Nagel et al. | |
| 2010/0258513 | A1 | 10/2010 | Meyer et al. | |
| 2010/0268792 | A1 | 10/2010 | Butler et al. | |
| 2011/0017684 | A1 | 1/2011 | Nagel et al. | |
| 2011/0174750 | A1 * | 7/2011 | Poulokefalos | 211/59.3 |
| 2011/0210086 | A1 | 9/2011 | Ciesick | |
| 2011/0215060 | A1 * | 9/2011 | Niederhuefner | 211/59.3 |
| 2011/0218889 | A1 | 9/2011 | Westberg et al. | |
| 2011/0282768 | A1 | 11/2011 | Swafford, Jr. et al. | |
| 2012/0006764 | A1 | 1/2012 | Hachmann et al. | |
| 2012/0091162 | A1 | 4/2012 | Overhultz et al. | |
| 2012/0255924 | A1 | 10/2012 | Kologe | |
| 2012/0273434 | A1 | 11/2012 | Niederhuefner et al. | |
| 2013/0008863 | A1 | 1/2013 | Valiulis | |
| 2013/0062295 | A1 * | 3/2013 | Bird et al. | 211/59.3 |
| 2013/0112634 | A1 | 5/2013 | Nagel | |
| 2013/0247834 | A1 | 9/2013 | Kodat | |

FOREIGN PATENT DOCUMENTS

| | | | |
|---|---|---|---|
| EP | 0 337 340 | A2 | 10/1989 |
| EP | 0 627 565 | A1 | 12/1994 |
| EP | 0 868 871 | A1 | 10/1998 |
| EP | 1 030 576 | B1 | 4/2002 |
| EP | 1 256 296 | A2 | 11/2002 |
| EP | 1 030 580 | A2 | 2/2005 |
| EP | 1 395 152 | B1 | 2/2005 |
| EP | 1 541 064 | A1 | 6/2005 |
| EP | 1 541 064 | B1 | 2/2006 |
| EP | 1 748 712 | A2 | 2/2007 |
| EP | 1 750 545 | A2 | 2/2007 |
| EP | 1 843 679 | A2 | 10/2007 |
| GB | 2 290 077 | A | 12/1995 |
| GB | 2 304 102 | A | 3/1997 |
| GB | 2 360 514 | A | 9/2001 |
| KR | 10-2004-0012832 | A | 2/2004 |
| KR | 10-2006-0135792 | A | 12/2006 |
| NL | 1001794 | C2 | 6/1997 |
| WO | WO 91/03967 | A1 | 4/1991 |
| WO | WO 99/25220 | A1 | 5/1999 |
| WO | WO 99/25229 | A2 | 5/1999 |
| WO | WO 00/71004 | A1 | 11/2000 |

(56) References Cited

FOREIGN PATENT DOCUMENTS

| | | | |
|---|---|---|---|
| WO | WO 02/091885 | A1 | 11/2002 |
| WO | WO 03/032775 | A2 | 4/2003 |
| WO | WO 2004/064484 | A2 | 8/2004 |
| WO | WO 2004/083051 | A2 | 9/2004 |
| WO | WO 2005/037027 | A1 | 4/2005 |
| WO | WO 2005/074563 | A2 | 8/2005 |
| WO | WO 2005/074564 | A2 | 8/2005 |
| WO | WO 2005/074616 | A2 | 8/2005 |
| WO | WO 2005/074635 | A2 | 8/2005 |
| WO | WO 2005/107535 | A1 | 11/2005 |
| WO | WO 2006/083774 | A2 | 8/2006 |
| WO | WO 2007/032917 | A2 | 3/2007 |
| WO | WO 2007/050527 | A2 | 5/2007 |
| WO | WO 2007/106751 | A2 | 9/2007 |
| WO | WO 2007/106822 | A2 | 9/2007 |
| WO | WO 2008/051996 | A2 | 5/2008 |
| WO | WO 2008/115769 | A2 | 9/2008 |
| WO | WO 2008/153561 | A1 | 12/2008 |

OTHER PUBLICATIONS

U.S. Appl. No. 14/109,029, filed Dec. 17, 2013, Nagel.
U.S. Appl. No. 14/152,619, filed Jan. 10, 2014, Juric.
U.S. Appl. No. 14/204,744, filed Mar. 11, 2014, Nagel.
POS Tuning Udo Voβhenrich, The POS Product Pusher; date last visited May 31, 2006, 1 page; http://www.postuning.de/69.0.html?&L=25/31/2006.
POS Tuning Udo Voβhenrich, The POS Systemtray; date last visited May 31, 2006, 1 page; http://www.postuning.de/69.0.html?&L=25/31/2006.

* cited by examiner

SNAP-IN PUSHER

FIELD OF THE INVENTION

This invention generally relates to pusher systems used in the display of retail merchandise.

BACKGROUND OF THE INVENTION

The retail industry contains many products that are utilized to push product towards the front of a shelf. The main elements of a pusher system include a front fences, connectors (push pins, adhesive tape, or magnets), dividers, pushers (track or trackless), and sometimes rear tracks. These items are used by stores in order to reduce employee's workload and enhancing the customers shopping experience by facing the products automatically. Employees will not be required to face product on the shelf and customers will not have to dig into the back of shelves to find product.

Pushers systems for retail merchandise that are available on the market allow for an either an infinite number of placements along the front rail axis or an incremental placement system of varying distances. This allows stores to customize the fit and function of the pusher system. Also, stores are able to squeeze more products into the available space. The problem with incremental systems is large gaps can appear in between products and dividers or offset pushers. This may cause the product being dispensed by the pusher system to bind along the pushing axis. Generally, conventional pusher systems attempt to deal with these issues with additional components that often require complex component arrangements and/or complicated assemblies.

It would therefore be desirable to have a pusher system for retail merchandise that addresses the aforementioned issues in a manner that does not entail the complexity and cost of conventional pusher systems. Embodiments of the present invention provide such a pusher system. These and other advantages of the invention, as well as additional inventive features, will be apparent from the description of the invention provided herein.

BRIEF SUMMARY OF THE INVENTION

In one aspect, the invention provides a retail merchandise pusher system that includes a front fence configured to attach to a shelf, and a plurality of single-piece track and divider assemblies. Each single-piece track and divider assembly has a divider attached to a track, and is configured to attach to the front fence by means of a connector. The retail merchandise pusher system also includes a pusher assembly for each of the plurality of single-piece track and divider assemblies. Each pusher assembly is configured to slide along its respective track. The pusher assembly has a pusher paddle, and a spring to bias the pusher paddle towards the front fence.

In a particular embodiment of the invention, each single-piece track and divider assembly is a single extruded piece. In more particular embodiments, each single-piece track and divider assembly is a single piece of extruded plastic. In certain embodiments, the track includes a first C-channel slot in which the pusher assembly slides. Also, the connector may include a first tab configured to be press fit into the first C-channel slot to facilitate attachment of the connector to its respective track and divider assembly. More particularly, the track may also include a second C-channel slot adjacent to the first C-channel slot first C-channel slot, where the connector has a second tab, and the second tab is configured to be press fit into the second C-channel slot to further facilitate attachment of the connector to its respective track and divider assembly. In at least one embodiment, an opening of the second C-channel slot faces a direction opposite that of an opening of the first C-channel slot, the divider attached to a flat portion of the second C-channel slot.

In some embodiments, each single-piece track and divider assembly is attached to a connector which can be removably attached to the front fence. A front fence is envisioned with a plurality of posts arranged in single file. A connector is envisioned as having a plurality of openings configured to slide onto at least some of the plurality of posts. In a particular embodiment, each of the plurality of openings is a semi-circular opening. The spacing between adjacent tracks and divider assemblies may be adjusted by moving one of the adjacent tracks and divider assemblies from one subset of the plurality of posts to another subset of the plurality of posts.

The front fence may include a plurality of fasteners configured to attach the front fence to a shelf having a plurality of openings to accommodate the plurality of fasteners. Furthermore, the front fence may include a plurality of slots to hold the fasteners, the slots being elongated so the front fence can be attached to different shelves each having a different spacing between its plurality of openings. The plurality of fasteners may be a plurality of screws, a plurality of push pins, or a plurality of bolts.

In certain embodiments, the track is perpendicular to the divider. Also, the pusher paddle may be arranged to mount onto a base plate configured to slide within the track of its respective track and divider assembly. Further, the pusher paddle may be perpendicular to the base plate. In some embodiments, the spring is coiled and mounted to the base plate or pusher paddle, and one end of the spring is anchored to a slot in the connector.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Embodiments of the present invention include a snap-in pusher that combines the track and divider while focusing on an incremental connection to the front fence with a minimum increment distance. The design of these embodiments is such that they are arranged to reduce the amount of components used by store personnel to setup the system. Further, certain embodiments of the invention allow for multiple user-selected positions for the track and divider to be placed along the front fence axis. This will discourage the accidental removal or tipping of the dividers and pushers. Additionally, certain embodiments allow the user to adjust the placement of the track and divider to any one of numerous points along the front fence axis.

Figure 1:
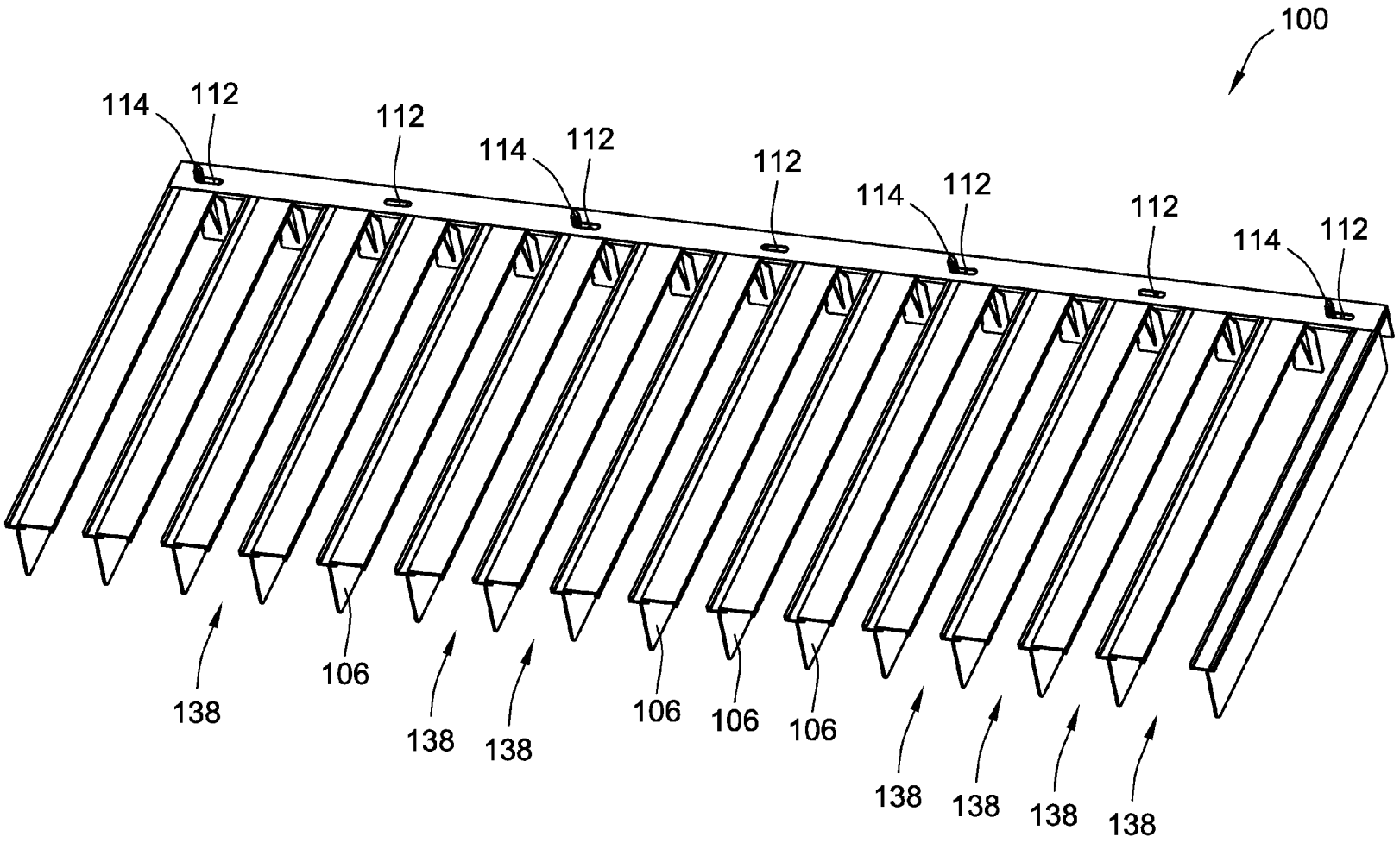
FIG. 1 is a perspective view of the snap-in pusher as seen from the bottom, in accordance with an embodiment of the invention.
Figure 2:
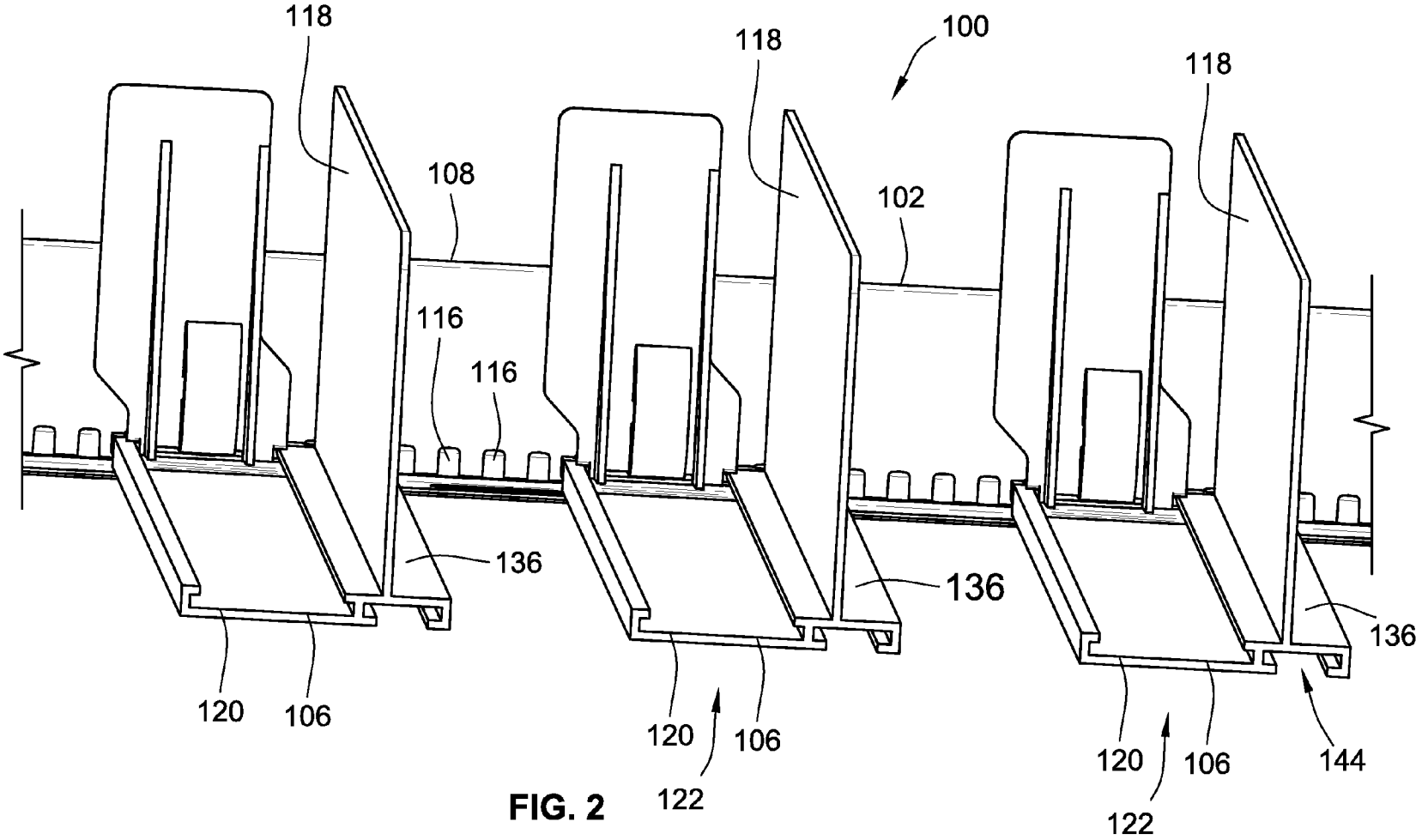
FIG. 2 is a perspective view of a front portion of the snap-in pusher, according to an embodiment of the invention.
Figure 3:
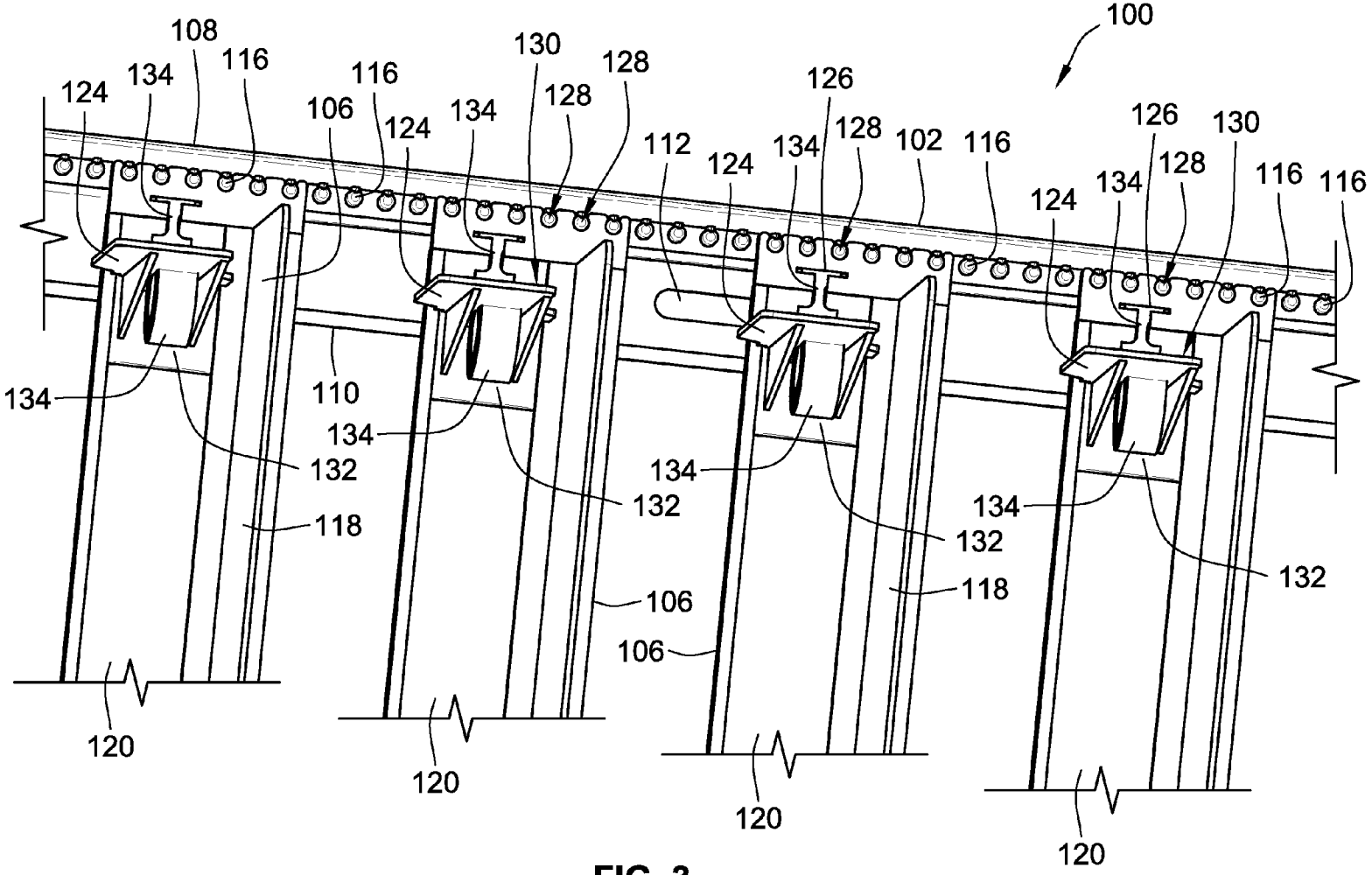
FIG. 3 is a perspective view of the snap in pusher as viewed from the top, according to an embodiment of the invention.
Figure 4:
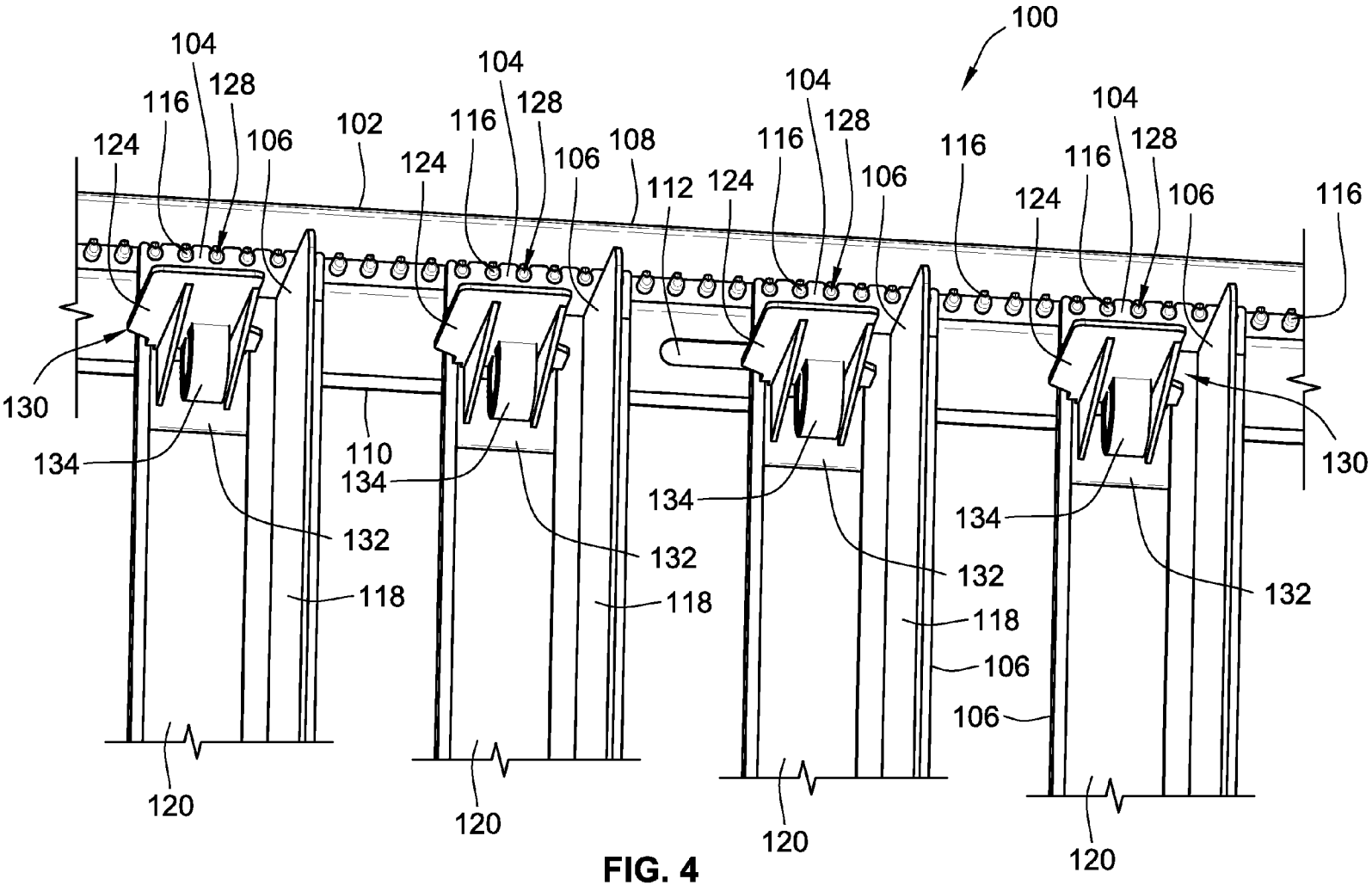
FIG. 4 is an alternate view of the snap in pusher as viewed from the top, according to an embodiment of the invention.
Figure 5:
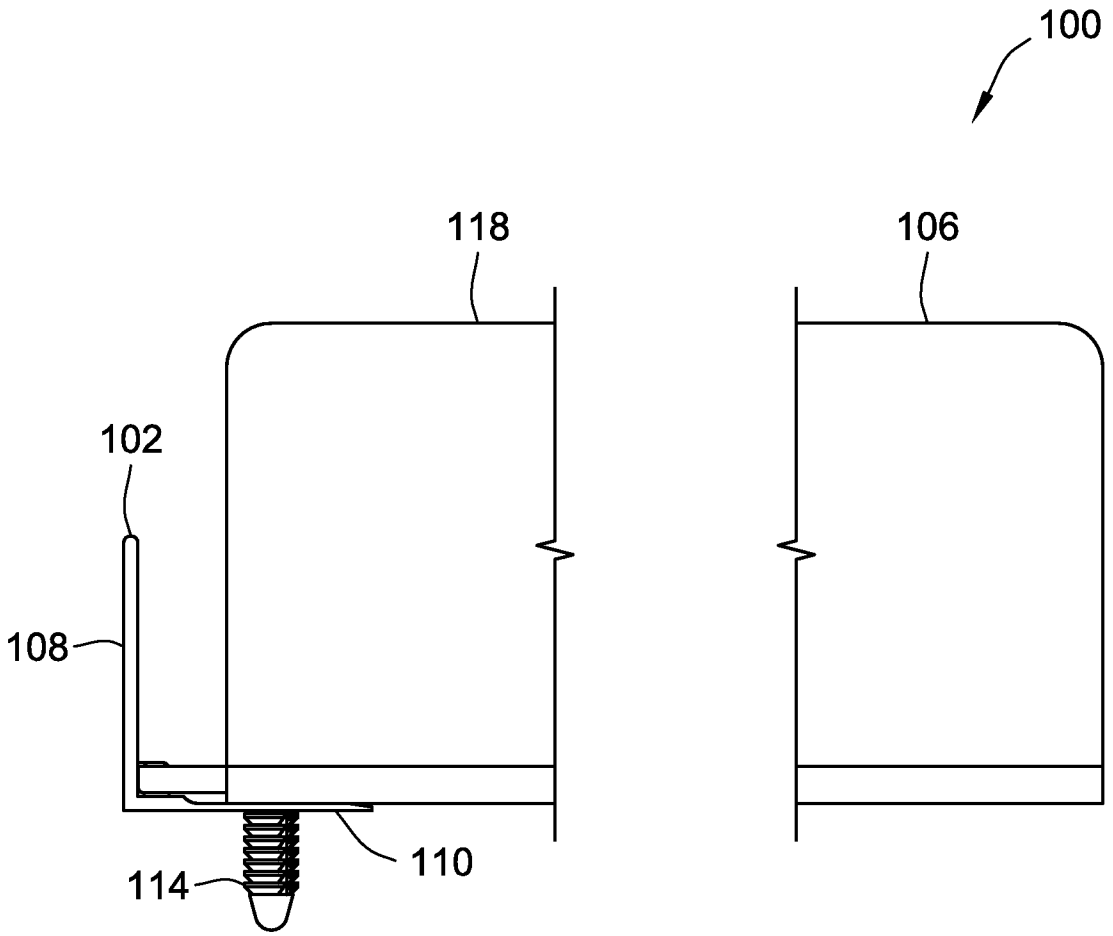
FIG. 5 is a plan view of the snap-in pusher of FIG. 1.
Figure 6:
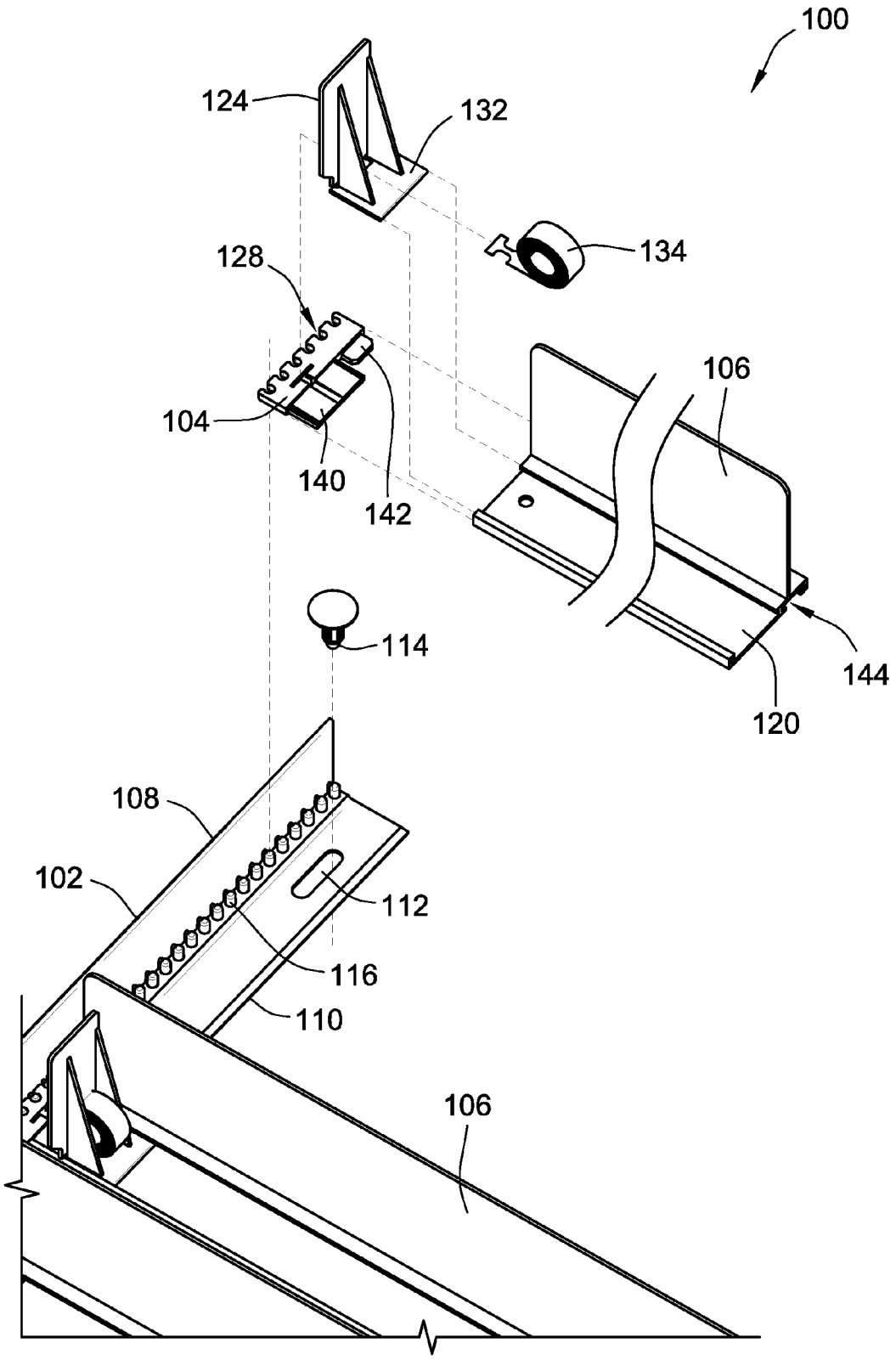
FIG. 6 is and exploded perspective view of a portion of the snap-in pusher, according to an embodiment of the invention.

FIGS. 1-4 are perspective views of a snap-in pusher 100, while FIGS. 5 and 6 show, respectively, a plan view and an exploded view of the snap-in pusher 100, constructed in accordance with an embodiment of the invention. The snap-in pusher 100 incorporates a design for the connection of the pusher system to a front fence 102. The front fence 102 is configured to grip the connectors 104 of a plurality of track and divider assemblies 106 to avoid tipping and accidental removal of products being held in the pusher 100. In a particular embodiment, the front fence 102 has a post-style interface configured to mate with like-shaped openings in a retail shelf, for example. The front fence 102 and track and divider assemblies 106 will be built together in order to reduce the amount components maintained by store personnel.

As shown in FIGS. 1-4, the front fence 102 includes a top portion 108 which comprises a vertical plane configured to contain products being dispensed by the snap-in pusher 100. The front fence 102 includes a bottom portion 110 comprising a generally horizontal plane with slots 112 designed to connect to a shelf (not shown). The front fence 102 can be connected to the shelf by a number of suitable means, such as push pins, adhesive, and magnets for example. The front fence slots 112 are configured to accept push pins, screws, or bolts for attachment to shelves. The plan view of FIG. 5 shows an embodiment of the snap-in pusher 100 in which screws 114 are inserted through the slots 112 to facilitate attachment to the shelf.

The front fence 102 includes a plurality of posts 116 that are located at an interface of the top and bottom portions 108, 110 of the front fence 102. More specifically, in the embodiment of FIG. 2-4, the plurality of posts 116 are arranged in single file and shown on an upper side of the bottom portion horizontal plane and an interior part of the top portion vertical wall. In certain embodiments, the individual posts 116 are uniformly spaced to allow for consistent incremental adjustment of the spacing between adjacent track and divider assemblies 106. As referenced above, the posts 116 serve as the point of attachment for the connectors 104 for the track and divider assemblies 106. Each track and divider assembly 106 has a divider 118 attached to a track 120. The track 120 provides a pathway for dispensing of retail merchandise, while the divider 118 separates the merchandise on adjacent tracks 120. In the particular embodiments shown, the track and divider assemblies 106 includes a divider 118 arranged vertically and attached at its base to a track 120 arranged horizontally.

In a particular embodiment of the invention, the track and divider assembly 106 is a single-piece track and divider assembly 106, manufactured as one extruded piece in order to reduce components and cost. The single-piece track and divider assembly 106 may be extruded plastic or metal. Other components of the snap-in pusher 100 may be made from injection molded plastic or from metal. In this embodiment, the track 120 includes a C-channel slot 122 configured to accept a base portion of a pusher paddle 124. The C-channel slot 122 controls the movement of the pusher paddle 124, ensuring that the pusher paddle 124 moves linearly along the track 120.

The snap in pusher 100 includes a plurality of pusher assemblies 130. Each pusher assembly 130 has the pusher paddle 124 attached to the base plate 132, which is configured to fit in the C-channel slot 122, and having a spring 134. In certain embodiments, the pusher paddle 124 is perpendicular to the base plate 132. In more particular embodiments, the pusher paddle 124 is arranged vertically, while the base plate 132 is arranged horizontally. The spring 134 may be a coil spring, which unrolls as the pusher paddle 124 is extended away from the front fence 102. In certain embodiments, the spring 134 may be mounted on the base plate 134 and/or the pusher paddle 124 with the spring 134 extending through a slot in the pusher paddle 124. In certain embodiments, the connector 104 has a slot 126 for connecting to the spring 134. For example, the spring 134 may have a curved or hooked end portion that can be inserted into slot 126 to anchor the spring the front fence 102 via the connector 104.

The connector 104 also includes a plurality of openings 128 with spacing identical to that of the plurality of posts 116, such that the connector openings 128 slide onto the posts 116 to secure the connector 104, and therefore the track and divider assembly 106, to the front fence 102. The connector 104 of FIGS. 3, 4, and 6 has six openings 128, though alternate embodiments of the connector 104 could have more or less than six openings 128. However, because each connector 104 has multiple openings 128, the connector 104, when placed onto the posts 116, provides a stable attachment for the track and divider assembly 106. This arrangement prevents any angular movement of the track and divider assembly 106, and provides stability without any connection at the opposite end of the track and divider assembly 106.

The base plate 132 is generally a flat, so that it will slide in the C-channel slot 122 of the track 120. In a particular embodiment, the spring 134 is mounted onto the base plate 132 at the back of the pusher paddle 124 (facing away from the front fence 102). A slot (not shown) through the pusher paddle 124 allows for the spring 134 to attach to the connector 104 via slot 126.

A typical retail shelf may include a plurality of openings which, in some cases, are arranged in parallel rows where the openings extend through the top surface of the shelf. Generally, the openings are in proximity to a front edge of the shelf. These openings can accommodate the screws 114 (shown in FIG. 5), push pins, bolts, or other fastening devices by which the front fence 102 may be attached to the shelf. In particular embodiments, the slots 112 in the front fence 102 are elongated with semi-circular ends such that the screws 114, push pins, or bolts can slide within the slot 114, thus allowing for horizontal adjustment of the positions of the snap-in pusher 100 from side to side. It also allows for the snap-in pusher 100 to be used in shelving system where the hole spacing varies considerably. Merchandise is situated on a flat surface 136 at the base on both sides of the divider 118 to create a level base for the products. In the embodiments shown, the flat surface 136 is horizontal and perpendicular to the attached divider 116. The spring 134 of each pusher assembly 130 biases a channel 138 or row of the retail merchandise toward the front fence 102.

Each set of adjacent dividers 118 defines a different channel 138 for the retail merchandise. The snap-in pusher assembly is configured such that the width of each channel 138 may be adjusted to accommodate a broad range of merchandise. Due to the high number of closely-spaced posts 116 on the front fence 102, the user can slide the connector 104 for any track and divider assembly 106 to the left or right in increments equal to the distance between the closely-spaced posts 116.

In the illustrated embodiment, the spring 134 is assembled onto in the pusher assembly 130, the spring 134 having a free end configured to secure in connector slot 126. As stated above, the spring 134, which may be a coil spring, can be dispensed linearly from the rolled coil when moving the pusher paddle 124 away from the front fence 102. Applicants, recognize that the spring 134 may be a spring other than a coil-type spring. Once dispensed, the spring 134 acts upon the pusher paddle 124 to bias it towards the front fence 102. As a result, any merchandise in contact with the pusher paddle 124 in the channel 138 is also biased forward until the frontmost item of merchandise engages the front fence 102. When the front most item of merchandise is removed from the channel 138 by a consumer, the row of merchandise is again biased forward and a portion of the spring 134 is retracted into the coiled roll until the next item of merchandise engages the front fence 102.

FIG. 6 is an exploded perspective view of the snap-in pusher 100, according to an embodiment of the invention. In this embodiment, the connector 104 is connected to the track and divider assembly 106 via a first 140 and a second tab 142. First tab 140 is inserted into C-channel slot 122, while second tab 142 is inserted into a second C-channel slot 144 adjacent to C-channel slot 122. In a particular embodiment, the second C-channel slot 144 is oriented 180 degrees with respect to C-channel slot 122, such that the openings of the two slots 122, 144 face in opposite directions. The divider 118 is attached perpendicularly to a closed side of the second C-channel slot 144, the closed side of the second C-channel slot 144 forming the above-referenced flat surface 136. First and second tabs 140, 142 are press fit into C-channel slot 122 and second C-channel slot 144, and held in place by friction. When the pusher system 130 is fully retracted, the base plate 132 abuts the first tab 140 in C-channel slot 122. In the embodiment of FIG. 6, the each of the plurality of openings 128 in the connector 104 is semi-circular to facilitate easy attachment to the plurality of posts 116 of the front fence 102.

Combining the track 120, divider 118, connector 104, front fence 102, and pusher system 130 in the manner shown herein, and illustrated in the accompanying drawings, provides a pusher system with a limited number of components, that is easy to install and maintain, has a stable base, and is relatively simple to operate.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail merchandise pusher system comprising:

a front fence configured to attach to a shelf;

a plurality of single-piece track and divider assemblies, each single-piece track and divider assembly having a divider attached to a track and configured to attach to the front fence by means of a connector; and a pusher assembly for each of the plurality of single-piece track and divider assemblies, each pusher assembly configured to slide along its respective track, the pusher assembly having a pusher paddle, and a spring to bias the pusher paddle towards the front fence;

wherein the track includes a first C-channel slot in which the pusher assembly slides;

wherein the connector includes a first tab configured to be press fit into the first C-channel slot to facilitate attachment of the connector to its respective track and divider assembly; and wherein the track has a second C-channel slot adjacent to the first C-channel slot, and the connector has a second tab, the second tab configured to be press fit into the second C-channel slot to further facilitate attachment of the connector to its respective track and divider assembly.

2. The retail merchandise pusher system of claim 1, wherein each single-piece track and divider assembly is a single extruded piece.

3. The retail merchandise pusher system of claim 2, wherein each single-piece track and divider assembly is a single piece of extruded plastic.

4. The retail merchandise pusher system of claim 1, wherein an opening of the second C-channel slot faces a direction opposite that of an opening of the first C-channel slot, the divider attached to a flat portion of the second C-channel slot.

5. The retail merchandise pusher system of claim 1, wherein each single-piece track and divider assembly is attached to the connector which can be removably attached to the front fence.

6. The retail merchandise pusher system of claim 1, wherein the front fence includes a plurality of posts arranged in single file, and wherein each connector has a plurality of openings configured to slide onto at least some of the plurality of posts.

7. The retail merchandise pusher system of claim 6, wherein each of the plurality of openings is a semi-circular opening.

8. The retail merchandise pusher system of claim 6, wherein the spacing between adjacent tracks and divider assemblies can be adjusted by moving one of the adjacent tracks and divider assemblies from one subset of the plurality of posts to another subset of the plurality of posts.

9. The retail merchandise pusher system of claim 1, wherein the front fence includes a plurality of fasteners configured to attach the front fence to a shelf having a plurality of openings to accommodate the plurality of fasteners.

10. The retail merchandise pusher system of claim 9, wherein the front fence includes a plurality of slots to hold the fasteners, the slots being elongated so the front fence can be attached to different shelves each having a different spacing between its plurality of openings.

11. The retail merchandise pusher system of claim 9, wherein the plurality of fasteners comprises one of a plurality of screws, a plurality of push pins, and a plurality of bolts.

12. The retail merchandise pusher system of claim 1, wherein the track is perpendicular to the divider.

13. The retail merchandise pusher system of claim 1, wherein the pusher paddle is mounted onto a base plate configured to slide within the track of its respective track and divider assembly.

14. The retail merchandise pusher system of claim 13, wherein the pusher paddle is perpendicular to the base plate.

15. The retail merchandise pusher system of claim 13, wherein the spring is coiled and mounted to the base plate or pusher paddle, and one end of the spring is anchored to a slot in the connector.

* * * * *